US005242322A

United States Patent [19]

Chellemi et al.

[11] Patent Number: 5,242,322

[45] Date of Patent: Sep. 7, 1993

[54] SAFETY FIN WATER SPORTS BOARDS

[75] Inventors: John P. Chellemi, 410 14th St., N.B., St. Augustine, Fla. 32095; Marc W. Fleming, 6309 Vista St., Long Beach, Calif. 90803

[73] Assignees: John P. Chellemi, St. Augustine, Fla.; Marc W. Fleming, Long Beach, Calif.

[21] Appl. No.: 709,380

[22] Filed: Jun. 3, 1991

[51] Int. Cl.[5] ..... A63C 15/06

[52] U.S. Cl. ..... 441/79; 441/74; 114/219; 280/608; 280/752; 293/102

[58] Field of Search ..... 114/127-143, 114/219; 441/65, 75, 79; 280/608, 11.12, 11.14, 87.042, 87.05, 752; 293/120, 102, 155

[56] References Cited

U.S. PATENT DOCUMENTS

| | | | |
|---|---|---|---|
| 2,861,533 | 11/1958 | Thomas | 114/162 |
| 3,481,619 | 12/1969 | Powers | 280/18 |
| 3,954,278 | 5/1976 | McLeod | 280/11.12 |
| 4,037,279 | 7/1977 | Ziebart | 441/79 |
| 4,304,557 | 12/1981 | Henrich | 440/66 |
| 4,733,496 | 3/1988 | Wallner | 441/79 |
| 4,762,080 | 8/1988 | Pearson | 114/219 |
| 4,909,172 | 3/1990 | Hamby | 114/219 |
| 5,003,904 | 4/1991 | Unger | 441/79 |
| 5,018,997 | 5/1991 | Guptill | 114/219 |

*Primary Examiner*—Joseph F. Peters, Jr.
*Assistant Examiner*—Clifford T. Bartz
*Attorney, Agent, or Firm*—Lyon & Lyon

[57] ABSTRACT

A fin for water sports boards having a urethane leading edge cover molded in place onto an anchor flange having holes therethrough on the leading edge of the fin. The fin is of glass fiber reinforced resin.

6 Claims, 1 Drawing Sheet

SAFETY FIN WATER SPORTS BOARDS

BACKGROUND OF THE INVENTION

The field of the present invention is water sports boards such as surfboards and the construction of fins therefor.

A variety of boards have been developed over the years for water sports activities including the use of such boards in ocean surf. Typically, such boards are of lightweight material so as to be relatively rigid. Frequently, a coating of glass fiber reinforced resin encases the board. For stability and control, such boards typically include fins. The fins are placed near the back of the board on the underside thereof to extend downwardly into the supporting water. Fins come in a variety of shapes and sizes according to the preferences of the designers and users. The fins are frequently positioned normal to the surface of the board but have also been used as angles to the normal as well.

The fin structures are rigidly mounted to the boards and are themselves rigid. The rigidity of a fin has been generally considered essential to avoid oscillations and cavitation, to insure control and to avoid directional instabilities.

The structural requirements and orientation of such fins on water sports boards and their use in a typically turbulent water environment create a hazardous condition. In the turbulence, the board itself can be driven by the water with injurious force. Some efforts have been made to cushion the leading portion of the board which is not subject to the same rigidity requirements of a fin. Rigid fins are typically of smaller cross section and are driven by the same forces driving the board in turbulent surf. Consequently, fins have a greater propensity to inflict injury to the human body. They are typically more knife-like, they extend clear of the supporting board and they are so rigidly attached to the supporting board that they are driven with the same momentum and force. Injuries due to fins are understood to be substantial in number on an ongoing weekly basis in the United States.

SUMMARY OF THE INVENTION

The present invention is directed to a safety fin designed to reduce the prospect of personal injury resulting from accidents involving water sports boards. To this end, a rigid fin is provided with a softer leading edge. To accomplish this, the leading edge of the fin includes an anchor flange extending outwardly from the leading edge. To the anchor flange, a cover is provided which encloses the flange and provides a fin-like shape to the assembly. A substantial part of the fin remains highly rigid and is intended to be rigidly coupled with a water sports board. Thus, oscillation, vibration, directional stability and the like are maintained. Additionally, material such as urethane guards the forward end of that rigid fin. The softer material in conjunction with the rigid fin body is then able to augment the performance required of conventional fins but effectively absorb energy and spread the impact zone upon impact against a person such that the prospects of injury are reduced.

Accordingly, it is an object of the present invention to provide an improved and safer fin structure for water sports boards. Other and further objects and advantages will appear hereinafter.

DETAILED DESCRIPTION OF THE PREFERRED EMBODIMENT

Figure 1:
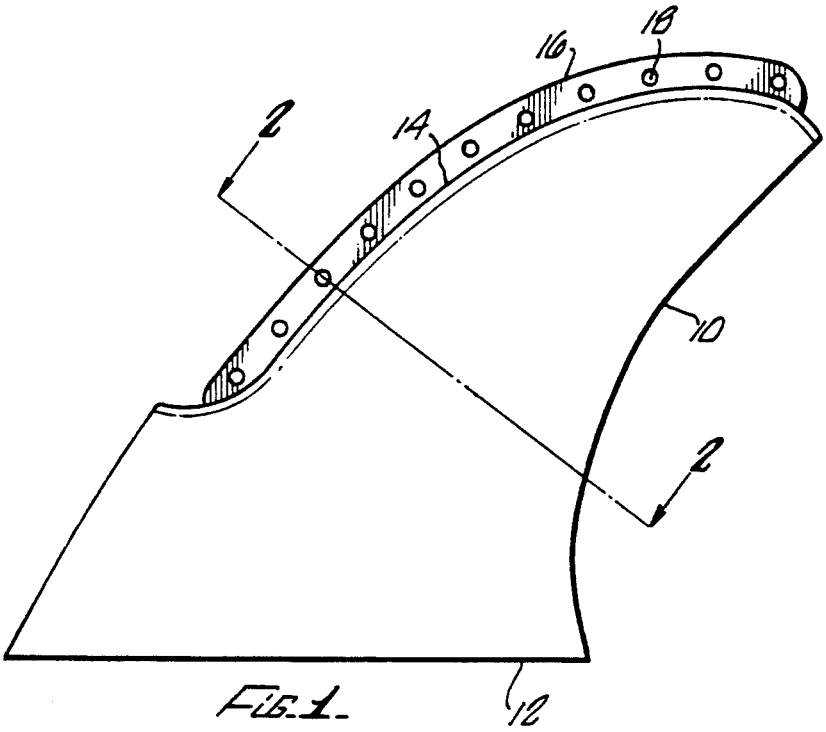
FIG. 1 is a side view of a fin base of the present invention.
Figure 2:
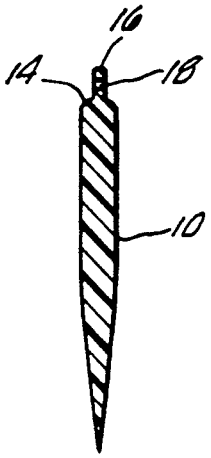
FIG. 2 is a cross-sectional view taken along line 2—2 of FIG. 1.
Figure 3:
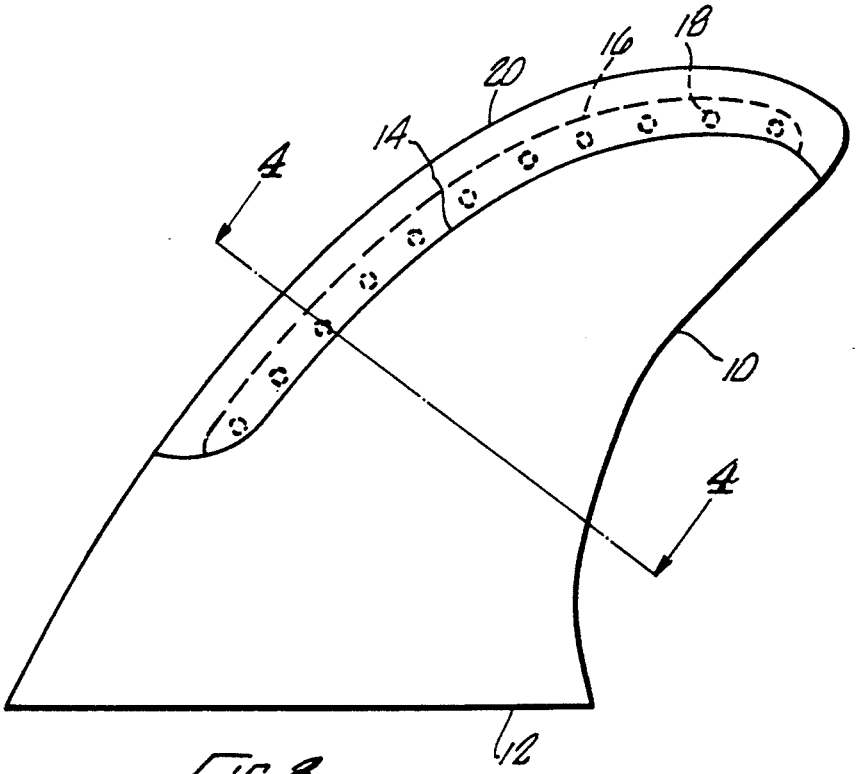
FIG. 3 is a side view of a safety fin of the present invention.
Figure 4:
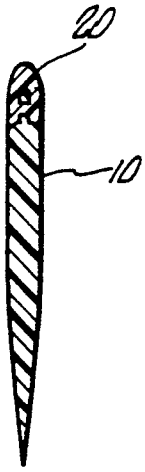
FIG. 4 is a cross-sectional view taken along line 4—4 of FIG. 3.

Turning in detail to the drawings, a safety fin is illustrated in FIGS. 3 and 4. The base component thereof is illustrated in FIGS. 1 and 2. Fins typically take on a wide variety of shapes and sizes. The fin illustrated in the Figures is simply an example of such a design with an almost infinite variety of other shapes being possible. The fin includes a rigid, inflexible fin base 10. The fin base 10 is thin in cross section as can be seen from FIG. 2. The fin base 10 is flat along its mating surface 12. This surface 12 is abutted against a sports board such as a surf board, water ski or the like in an appropriate location and held in place by glass fiber reinforced resin extending between the board and the base on either side of the base.

The fin is generally designed to be positioned on a water sports board in a specific orientation such that a leading edge 14 is defined. In this example, the leading edge 14 is shown to extend from above the mounting area of the fin to the end of the curve where it intersects the trailing edge. Also in this example, the edge is recessed to provide a smooth transition with the attachment portion.

Extending along the leading edge 14 is an anchor flange 16. The anchor flange 16 is integrally formed with the fin base 10 and lies in the center plane of the fin base. The anchor flange 16 extends outwardly from the leading edge 14 in such a way as to provide displacement from the anchor flange 16 to a continuation of the surfaces of the fin base 10. In this way, room is provided for a leading edge cover. Anchor holes 18 are spaced along the anchor flange 16 for increased interlocking purchase of a soft cover.

Molded in place to the leading edge 14 of the fin base 10 about the anchor flange 16 is a leading edge cover 20. The cover 20 is of softer material than the fin base 10. The technique of molding in place allows the material to penetrate the holes 18 so as to become interlocked with the anchor flange 16. As can best be seen in FIGS. 3 and 4, the leading edge cover 20 is molded to complete a smooth hydrodynamic shape. This shape is such that it minimizes turbulence and drag. Additionally, the shape presents a substantial wall thickness about the anchor flange 16.

The fin base 10 is made of conventional material to which the leading edge cover 20 and laminations to the board itself will adhere. Rigidity is also required as well as relative toughness. Glass fiber reinforced resin is a convenient material for this use. The leading edge cover 20 may be of urethane. The urethane is softer than the glass reinforced resin and yet is reasonably tough. The cross section of the leading edge cover is such that rigidity for purposes of maintaining the stability of the fin is not impacted.

Accordingly, a safety fin for water sports boards is disclosed which provides for softer impact between the fin and riders' and swimmers' bodies as well as other obstacles. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A safety fin for water sports boards, comprising a rigid, inflexible fin base of thin cross section with a distal end and a leading edge extending to said distal end, said leading edge including an anchor flange of thinner cross section than said fin base at said leading edge, extending outwardly from said leading edge substantially in line with the plane of said fin base and integral therewith, said anchor flange including holes therethrough;

a leading edge cover, symmetrical about a longitudinal centerline thereof and enclosing said anchor flange along said leading edge, said leading edge cover being substantially softer than said rigid, inflexible fin base and extending at least to and over said distal end and being molded in place on said rigid, inflexible fin base, said holes being for increased purchase by said leading edge cover on said rigid, inflexible fin base, said leading edge cover and said rigid, inflexible fin base at said leading edge together forming a substantially smooth outer surface.

2. A safety fin for water sports boards, comprising a rigid, inflexible fin base of thin cross section with a distal end and a leading edge extending to said distal end, said leading edge including an anchor flange of thinner cross section than said fin base at said leading edge, extending outwardly form said leading edge substantially in line with the plane of said fin base and integral therewith, said anchor flange including holes therethrough;

a leading edge cover, symmetrical about a longitudinal centerline thereof and enclosing said anchor flange along said leading edge, said leading edge cover being substantially softer than said rigid, inflexible fin base and extending at least to and over said distal end.

3. The safety fin of claim 2 wherein said leading edge cover is molded in place on said rigid, inflexible fin base.

4. The safety fin of claim 2 wherein said leading edge cover is urethane.

5. The safety fin of claim 4 wherein said fin is glass fiber reinforced resin.

6. The safety fin of claim 2 wherein said leading edge cover and said rigid, inflexible fin base at said leading edge together form a substantially smooth outer surface.

* * * * *